US005947105A

United States Patent [19]

Scott et al.

[11] Patent Number: 5,947,105

[45] Date of Patent: Sep. 7, 1999

[54] AMMUNITION BOX STOVE

[75] Inventors: Clayton Scott; Terry M. Richardson; Michael Skeens, all of Golden, Colo.

[73] Assignee: 20 M M Hotbox Corp., Pine, Colo.

[21] Appl. No.: 08/796,783

[22] Filed: Feb. 6, 1997

[51] Int. Cl.[6] ..... F24C 1/16

[52] U.S. Cl. ..... 126/9 R; 126/25 R; 29/403.1; 29/401.1

[58] Field of Search ..... 126/9 R, 59, 29, 126/60, 25 R, 11, 19 M, 275 R, 225, 222, 28; 206/3; 224/931; 29/403.1, 401.1

[56] References Cited

U.S. PATENT DOCUMENTS

| | | | |
|---|---|---|---|
| 272,599 | 2/1883 | Tappeiner | 126/9 R |
| 889,187 | 6/1908 | Ball | 126/9 R |
| 1,051,503 | 1/1913 | Klein | 126/9 R |
| 1,092,027 | 3/1914 | Davis | 126/9 R |
| 1,540,073 | 6/1925 | Hugo et al. | 126/9 R |
| 1,545,584 | 7/1925 | Devereux | 126/9 R |
| 1,785,143 | 12/1930 | Conk | 126/9 R |
| 2,119,798 | 6/1938 | Sivey | 126/9 R |
| 2,119,799 | 6/1938 | Sivey | 126/9 R |
| 2,334,847 | 11/1943 | Spiers | 126/9 R |
| 2,403,134 | 7/1946 | Stephenson | 126/9 R |
| 2,485,667 | 10/1949 | Sims | 126/9 R |
| 2,511,515 | 6/1950 | Schmitt | 126/9 R |
| 2,781,037 | 2/1957 | Vuncannon | 126/9 R |
| 2,786,463 | 3/1957 | Vincent | 126/9 R |
| 2,922,414 | 1/1960 | Brender | 126/9 R |
| 2,983,269 | 5/1961 | Montesano | 126/9 R |
| 3,049,071 | 8/1962 | Diack | 126/9 R |
| 3,395,691 | 8/1968 | Skarsten | 126/9 R |
| 3,880,139 | 4/1975 | Young | 126/9 R |
| 4,069,806 | 1/1978 | Landry | 126/9 R |
| 4,121,561 | 10/1978 | Cote | 126/9 R |
| 4,351,314 | 9/1982 | Morton | 126/9 R |
| 4,911,140 | 3/1990 | Robinson | 126/9 R |
| 5,119,799 | 6/1992 | Cowan | 126/9 R |

*Primary Examiner*—Ira S. Lazarus
*Assistant Examiner*—David Lee
*Attorney, Agent, or Firm*—Ramon L. Pizarro; Edwin H. Crabtree

[57] ABSTRACT

A portable stove and a method for fabricating portable stove from an ammunition box. The stove uses the ammunition box as the body for the stove. An outlet is incorporated into the lid area of the ammunition box to allow for the attachment of a flue duct to the hollow body. A door with vents may also be included in one of the sides of the ammunition box so that fuel may be burned within said hollow body and the products of the burning of the fuel may escape the hollow body through the outlet and into the flue duct.

14 Claims, 3 Drawing Sheets

AMMUNITION BOX STOVE

BACKGROUND OF THE INVENTION

1. Field of the Invention

This invention generally relates to a device and method of manufacture relating to a portable stove made from an ammunition box, and more specifically, but not by way of limitation, to an ammunition box stove and a method for converting an ammunition box into a portable stove.

2. Discussion of Prior Art

Small portable or camping stoves have been used extensively for providing heat for living areas as well as for cooking. These stoves are often used during camping, hunting, or other outdoor activity. The known stoves are typically made from specially designed sheet metal sections that are used to form the body of the stove. This typically results in bulky structures with a single intended use. The specialized manufacture translates into high cost to the consumer and an inefficient use of available materials, since specialized designs require the use of raw stock materials instead of taking advantage of pre-existing components.

Known portable stoves include devices taught in U.S. Pat. No. 4,911,140 to Robinson, which teaches a collapsible portable stove. The Robinson device is made from sections of sheetmetal or the like which have been configured for the assembly of the Robinson device.

Another portable stove is taught in U.S. Pat. No. 4,708,122 to Rock, which teaches a device for burning alcohol based fuels. The stove is specially designed for the purpose of burning alcohol, and thus is made from specialized parts and is best suited for burning a particular kind of fuel.

Still other portable stoves and cooking devices are taught in U.S. Pat. Nos. 5,261,386 to Burkhart, 5,143,046 to Koziol, 5,024,208 to Hottenroth et al., and Des. 254,165 to Woodward. These devices suffer form the limitations that they all require the extensive use of customized components and offer important advantages while burning specific kinds of fuels. Thus the devices in the known prior art are particularly well suited for specific fuels, and thus there remains a need for a portable stove that offers a high degree of versatility in that it can be easily modified to burn a variety of fuels, whether they solid fuels such as wood or charcoal, or gas or other fluidized fuels.

Thus there remains a need for a versatile, compact, inexpensive stove that can be easily modified and which serves for camping and other outdoor sports.

Importantly, there remains a need for a compact stove that takes advantage of existing devices to convert these devices into a stove.

There remains a need for a simple stove that offers economies in manufacture and that produces high temperature heat with a variety of fuels.

There remains a need for a portable system that takes advantage of materials that have been considered waste materials, to produce a compact, highly efficient stove that can burn a variety of fuels.

SUMMARY

It has been discovered that the above problems, which had been left unsolved by the known prior art, can be solved by providing a stove that includes the following elements:

a) a hollow body made from an ammunition box; and b) an outlet for attaching a flue duct to the hollow body.

While it is contemplated that a portable stove could be made from any ammunition box, in a preferred embodiment the stove is made from a box made to hold 20 mm ordnance. The ammunition box used to make the preferred embodiments is made in accordance with the military specifications for what is known as the M548 storage and shipping container. It has been discovered that the use of the M548 storage and shipping container as the platform from which to build a portable stove offers many unexpected and useful results which were not addressed by the known prior art.

An important new useful result achieved with the instant invention is that by converting an ordnance storage and shipping container, which will be referred to herein as an ammunition box, as the body or chamber for a portable stove one can take advantage of an existing device to form another new and useful device. Thus the conversion in essence teaches how to recycle an ammunition box to produce a portable stove.

Furthermore, it has been discovered that due to the fact that the ammunition boxes are made from a heavy gage steel, typically a 16 gage sheetmetal, results in a highly efficient stove that resists warping can be made.

It has also been found that a portable stove made in accordance with the instant invention can be used to burn a variety of fuels. This includes solid fuels such as wood or coal, as well as fluidized fuels such as propane. The modifications to ammunition box are few, and take advantage of the construction of the box to produce several of the functional aspects of the invention. For example, the top of the box typically comprises a removeable lid. This lid can as a cooking surface as well as be used to support a flue duct. The removeable lid also facilitates the insertion of a separation means that can support solid fuels within the ammunition box in order to allow proper aeration of the fuels being burned as well as serving as an additional cooking surface. Still further, one of the sides of the ammunition box may be cut and used to support a door with a damper that allows air to enter the ammunition box while burning fuel. The door as well as the removeable top can be used to place items into the stove, so that large items may be cooked or heated within the stove. Still further, it is contemplated that a gas line may be connected to the stove in order to allow gas operation of the stove.

Thus it can be appreciated that another aspect of the instant invention includes a method for converting an ammunition box into a portable stove. The method includes the following steps:

a) providing an ammunition box having at least one side and a removeable lid;

b) cutting an aperture for a flue duct in the removeable lid of the ammunition box;

c) providing an aperture in the side of the ammunition box in order to allow air to enter the ammunition box, so that fuel may be burned inside the ammunition box by allowing air to enter the aperture on the side of the ammunition box and the products of combustion allowed to exit through the aperture in the removeable lid.

Thus it is contemplated that an access door having a damper may be advantageously provided in order to control the amount of air entering the body of the stove. Also, a separating means for supporting articles within the ammunition box is also contemplated in order to allow circulation of air within the body of the stove, so that proper burning of solid fuels can be carried out.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
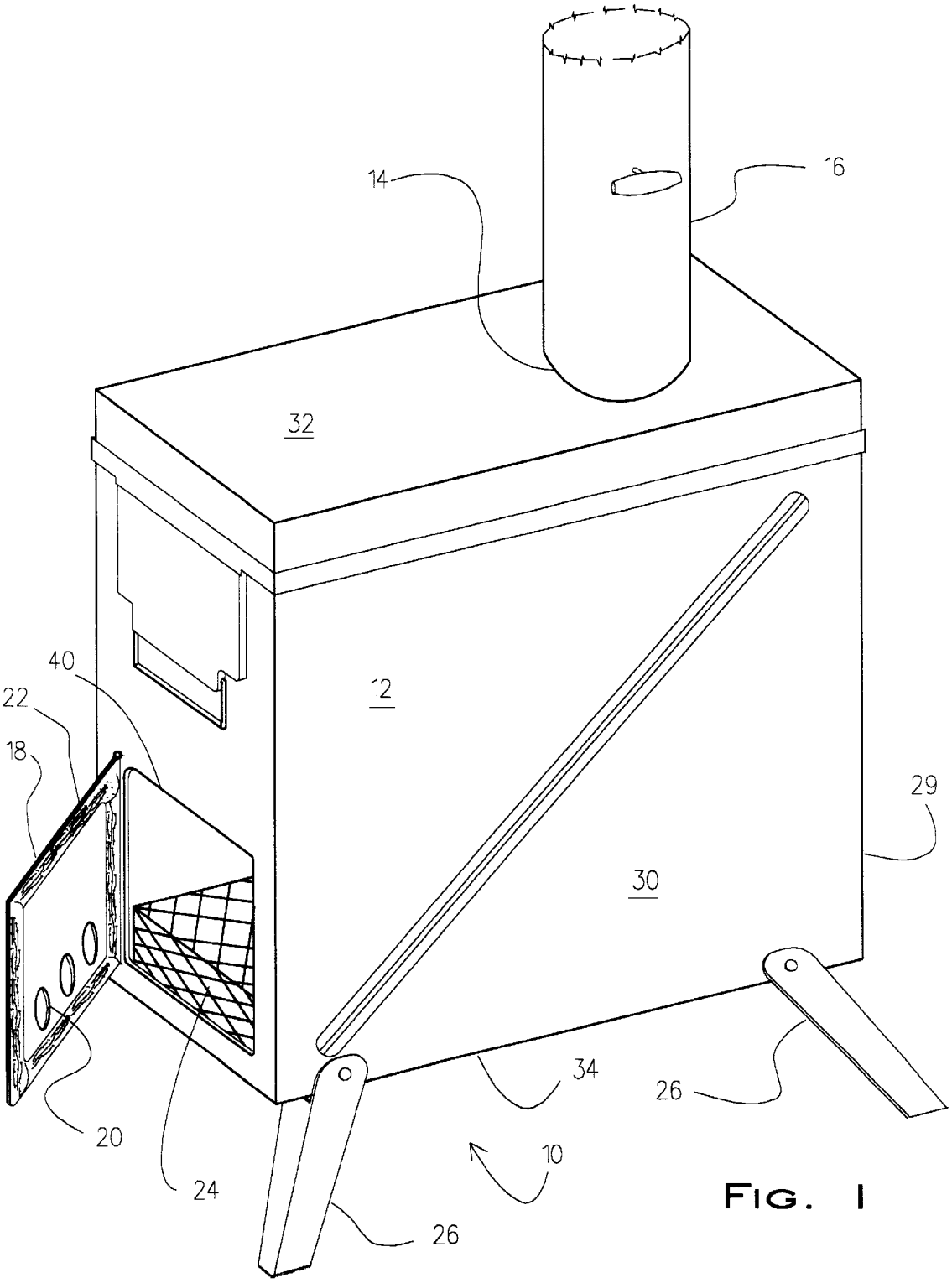
FIG. 1 is a perspective view of a preferred embodiment of the invention, the view showing the invention having an access door that allows access to the chamber of the stove.

Turning now to FIG. 1 where a portable stove 10 made in accordance with the instant invention is shown. The portable stove 10 includes a hollow body 12 made from an ammunition box; and an outlet 14 for attaching a flue duct 16 to the hollow body 12. Also shown on FIG. 1 is an access door 18 with a latch 19 and a damper 20. Inside the door 18, the borders of the door 18 are bounded with a seal 22 that is made from woven fiberglass or other heat resistant material that serves to insulate and seal off the boundary between the door 18 and the hollow body 12.

Also shown on FIG. 1 is a separating means 24 which is used to hold solid fuels such as wood or charcoal over the bottom of the stove, and thus allowing air to circulate below and above the fuel being burned within the stove 10. It is also contemplated that the separating means 24 may also be used to support items being cooked within the stove 10, such as a pan with food or food items wrapped in aluminum foil, for example. It is important to note that while the separating means 24 that have been shown include means made from steel mesh, other heat resistant components may be used. These embodiments include grill surfaces mounted on legs and the like.

Figure 9:
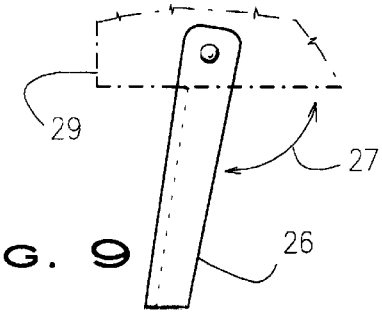
FIG. 9 illustrates an embodiment of collapsible legs that may be incorporated to the stove as taught herein.
Figure 10:
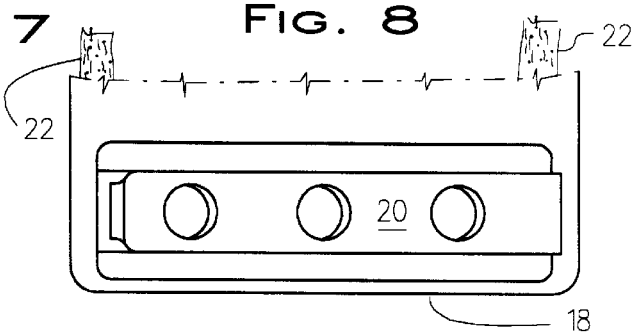
FIG. 10 is a detail view of the door on the stove as taught herein, the view illustrating the damper and the fire resistant material used as a seal about the edges of door.

Also shown on FIG. 1 are the folding legs 26, which may be pinned to the side of the stove as shown on FIG. 9. The legs 26 will support the stove over the floor area and allow heat to be transferred from the bottom of the portable stove 10, which coincides with the bottom 34 of the ammunition box 28. The folding feature of the legs 26 has been shown on FIG. 9, where the direction of folding indicated by arrow 27. It is contemplated that the folding feature of the legs will enhance the ease of stowage of the instant invention. Thus while the preferred embodiment of the invention includes folding legs, it is contemplated that other methods may be used to provide collapsing legs. Amongst these methods is the use of male legs that fit into female receptacles (not shown) on the hollow body of the portable stove 10.

Figure 2:
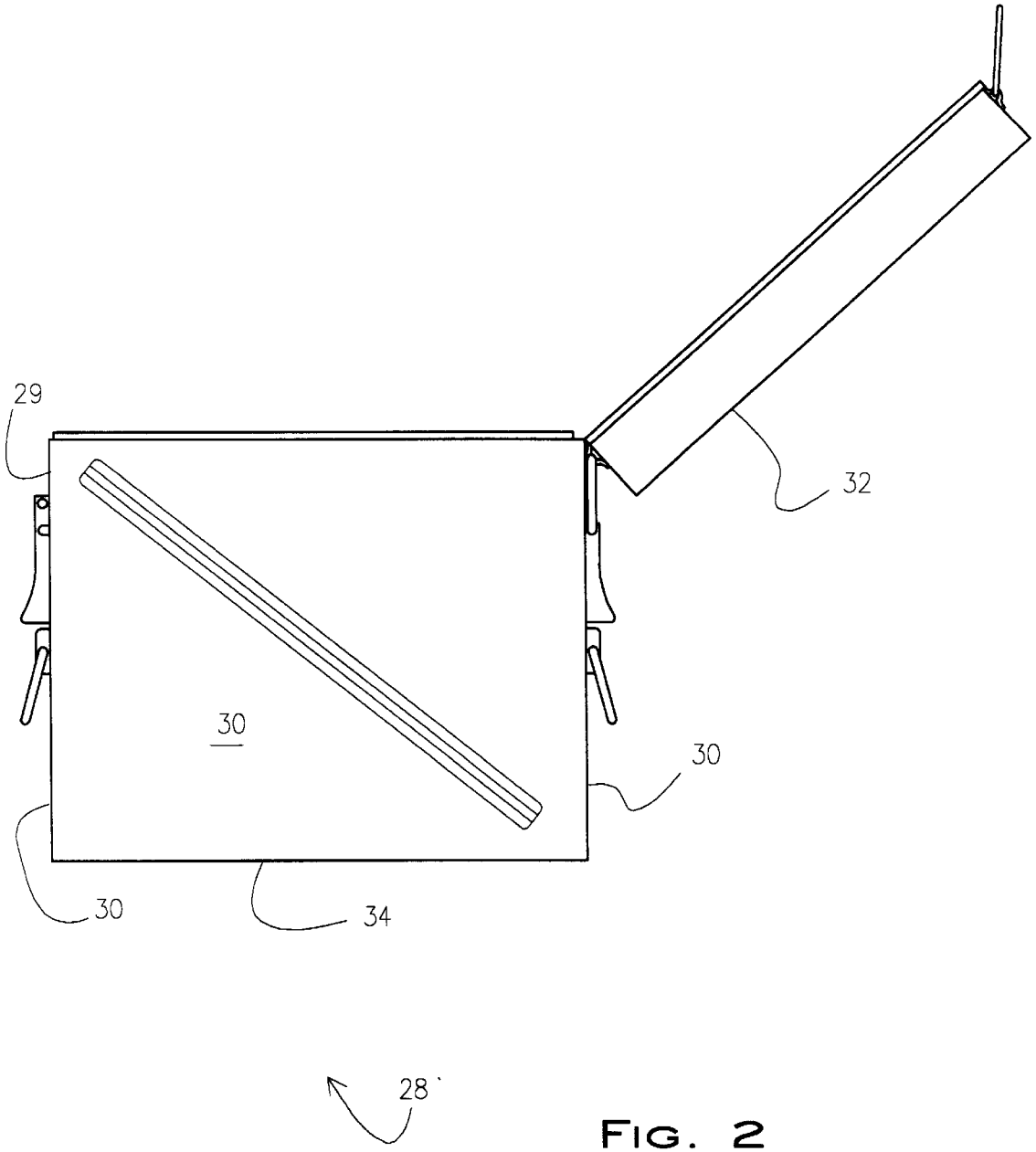
FIG. 2 is a side view illustrating a typical ammunition box which serves as the starting point for the manufacture of the hollow body of the stove taught herein.

Turning now to FIG. 2 where a typical M548 storage and shipping container 28 has been illustrated. The storage and shipping container is made in accordance with United States Military Specifications contained in the U.S. government TDP for part number 7258943. The storage and shipping container is designed to serve as an ammunition box for holding 100 20 mm ordnance cartridges, and will be referred to herein as an ammunition box. It is important to note that while the ammunition box for 100 20 mm cartridges serves as the basis for the preferred embodiment discussed herein, it is contemplated that a portable stove in accordance with the invention taught herein may be made from any ammunition box, so long as the box is primarily steel or another heat resistant, heat conductive material.

The ammunition box, or storage and shipping container, 28 includes a body 29 that includes a plurality of sides 30, a bottom 32 and a lid 34. The lid 34 is held on to the body 29 by means of the latches 36 that hold the lid on to the body 29. Thus the lid 34 may be completely removed from the body 29, if so desired.

The conversion of the ammunition box 28 into a portable stove 10 starts with providing an ammunition box having at least one side and a removeable lid. Then an aperture is cut into the lid 34 in order to provide the outlet 14 for a flue duct 16. The lid 34 in an M548 storage and shipping container typically includes a polymer seal that seals between the lid 32 and the body 29 of the ammunition box. This seal should be removed in order to prevent the polymer from burning when the ammunition box is used as a stove. Clearly, since the instant invention contemplates the use of discarded or surplus ammunition boxes as the starting point for the manufacture of a stove as taught herein, it is also contemplated that the ammunition boxes may be manufacture without the seals in order to take advantage of the tooling already in existence, and then transforming these ammunition boxes into portable stoves in accordance with the principles taught herein.

After the outlet 14 has been provided in the lid 32, an aperture 40 should be placed in one of the sides 30 of the ammunition box 28. The aperture 40 is supplied in order to allow air to enter the body 29 ammunition box 28 when the box has been transformed into a stove. The aperture 40 will allow air to enter the body 29 so that fuel may be burned inside the ammunition box. A flow of air that commences at the aperture 40 and flows on through to the outlet 14 can be established by installing a flue duct 16 and establishing a current through the system by allowing the warmed air to travel through the duct 16, and hence causing the duct 16 to draw fresh air through the aperture 40.

While it is contemplated that the function of the aperture 40 may be accomplished by means of a permanent aperture or by means of a damper 20 that allows the user to adjust the amount of air flow though the system, it is contemplated that by attaching an access door 18 over the access aperture 40, and providing a damper 20 on the access door 18 one allows the user to place items within the stove, while still providing the air flow control needed to control the burning of the fuel inside the stove.

While the damper 20 has been shown as a sliding gate which allows the covering of holes in the access door 18, it is contemplated that one may choose the type and size of damper depending on the particular needs and availability for the manufacturer.

Figure 3:
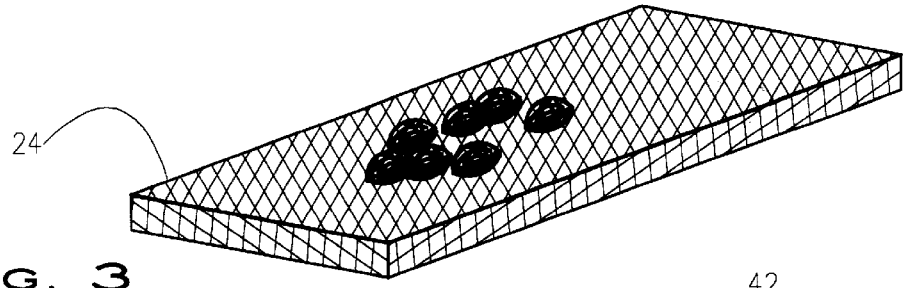
FIG. 3 is a perspective view of an internal separating means, the means shown used to support coals and allowing the circulation of air about the solid fuel being burned.
Figure 4:
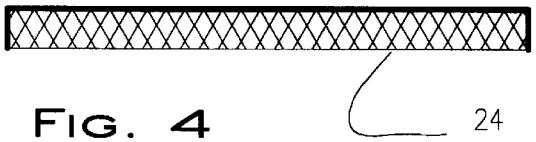
FIG. 4 is a side view of the separating means shown on FIG. 3.
Figure 5:
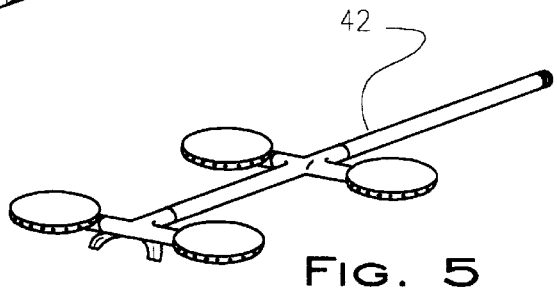
FIG. 5 is a perspective view of an optional gas distributing means that may be inserted below the separating means. The gas distributing means being used when the invention is to be used as a gas burning stove.

Referring now to FIGS. 3 through 5 it can be understood that the separating means 24 can serve for supporting articles with in the chamber of the stove 10. However, it is also contemplated that the stove may be fitted for burning fluidized fuels. Thus a set of burners 42, as shown on FIG. 5, could be mounted below the separating means 24.

Figure 6:
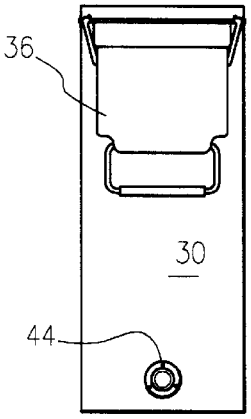
FIG. 6 shows an end elevational view of the rear end of an ammunition box equipped with a gas line inlet for use with the gas distributing means shown on FIG. 5.
Figure 7:
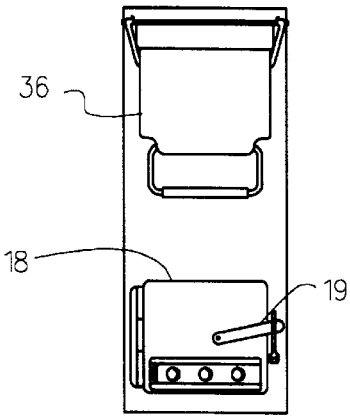
FIG. 7 is an end elevational view of the front end of an ammunition box that has been modified in accordance with a preferred embodiment of the instant invention. The view illustrating an access door with a damper system to allow the flow of air into the main chamber of the stove.

As shown on FIG. 6, a fluidized fuel connection 44 is preferably attached to one of the sides 30. The connection 44 positions and aids in the support of the burners 42 within the chamber of the stove 30. Thus as shown on FIGS. 6 and 7, the portable stove 10 include the fuel connection 44 on one of the sides of the ammunition box and has the access door 18 on an opposing side. This arrangement will allow access to the chamber of the stove 30 from one side of the stove to allow cooking within the stove, while allowing connection of the stove to an external source of fuel. It is contemplated that these external sources of fuel include propane or LPG gas, or other fuels.

Figure 8:
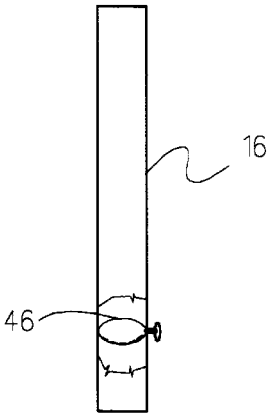
FIG. 8 illustrates a stove pipe that may be inserted into the stove as taught herein.

As shown on FIG. 8, the flue duct 16 may be a simple rounded tubing, which may be of double walled construction to prevent burning of things that come into contact with the flue duct 16. It is contemplated that the use of a double wall flue duct 16 will allow the use of the stove within structures such as tents and the like. Also, the flue duct 16 may also have an adjustable flue door 46 which serves to control the flow of air through the stove in order to control the burning of fuel within the stove.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A portable, stackable stove comprising:

a hollow body consisting of an ammunition box, the ammunition box consisting of:

a steel ammunition box body, the ammunition box body having a top and a bottom, four parallel sides, two of the sides being generally parallel to opposing sides, each of the two opposing parallel sides having a latch, one of the latches having a hinge, the ammunition box body further having a fixed bottom connecting all four sides at the bottom of the ammunition box body, the fixed bottom being generally perpendicular to the sides, the ammunition box further having a removable lid, the removable lid being attached to the body by the hinge, the removable lid further having means for cooperating with the latches on the body, so that the removable lid swings over the top of the body and accepts the two latches to close the top of the ammunition box body;

the removable lid having an aperture and a flue duct connection positioned within the lid aperture;

at least one of the sides of the ammunition box body having an aperture and a door for covering the aperture, the door being attached next to the aperture; and a set of collapsible legs pivotally connected to the bottom of the ammunition box body, so that fuel may be burned inside the ammunition box body by allowing air to enter the aperture on the side of the ammunition box body and the products of combustion allowed to exit through the aperture in the removable lid, and so that the portable stove is stackable by collapsing said legs.

2. A portable, stackable stove according to claim 1 wherein said collapsible legs are generally angled sections pivoting from a position where the angled legs nest against the lower portion of the body to a position where the legs extend away from the ammunition box body to support the ammunition box body.

3. A portable, stackable stove according to claim 1 and further comprising a removable separating means for supporting articles over the bottom of the ammunition box body wherein the removable separating means is detachable from the ammunition box body.

4. A portable, stackable stove according to claim 1 wherein said aperture in the removable lid is positioned near the hinged side of the ammunition box body and occupies a portion of the removable lid, so that the remaining portion of the removable lid serves as a cooking surface.

5. A portable, stackable stove and storage box comprising:

a hollow body consisting of an ammunition box consisting of:

a steel ammunition box body, the ammunition box body having a generally rectangular top and a bottom, four parallel sides, two of the sides being generally parallel to one another and being smaller than the remaining two sides, each of the two smaller opposing parallel sides having a latch, one of the latches having a hinge, the ammunition box body further having a fixed bottom connecting all four sides at the bottom of the ammunition box body, the fixed bottom being generally perpendicular to the sides, the ammunition box further having a removable lid, the removable lid being attached to the body by the hinge, the removable lid further having means for cooperating with the latches on the body, so that the removable lid swings over the top of the body and accepts the two latches to close the top of the ammunition box body;

a flue aperture in the removable lid, said flue aperture being positioned near the hinge, and a flue duct positioned within the lid aperture;

a door aperture in the smaller sides of the ammunition box body, smaller side being opposite to the side having a hinge; and a set of collapsible legs pivotally connected to the bottom of the ammunition box body, so that fuel may be burned inside the ammunition box by allowing air to enter the aperture on the side of the ammunition box and the products of combustion allowed to exit through the aperture in the removable lid, and so that the portable stove is stackable by collapsing said legs.

6. A portable, stackable stove according to claim 5 wherein said collapsible legs are generally angled sections pivoting from a position where the angled legs nest against the lower portion of the body to a position where the legs extend away from the ammunition box body to support the ammunition box body.

7. A portable, stackable stove according to claim 5 and further comprising a removable separating means for supporting articles over the bottom of the ammunition box body wherein the removable separating means is detachable from the ammunition box body.

8. A portable, stackable stove according to claim 5 wherein said aperture in the removable lid is positioned near the hinged side of the ammunition box body and occupies a portion of the removable lid, so that the remaining portion of the removable lid serves as a cooking surface.

9. A portable, stackable stove according to claim 5 and further comprising means for receiving and burning fluidized fuels within said ammunition box body.

10. A method for recycling an ammunition box by converting the ammunition box into a portable, stackable stove, the method comprising the steps of:

providing a stackable ammunition box consisting of:

a steel body having a top and a bottom, the body further having four parallel sides, two of the sides being generally parallel to one another and being smaller than the remaining parallel sides, each of the two smaller opposing sides having a latch near the top of the steel body, one of the latches having a hinge, the body further having a fixed bottom connecting all four sides at the bottom of the body and being generally perpendicular to the sides, the ammunition box further having a lid, the lid being retained on the body by the hinge, the removable lid further having means for cooperating with the latches on the body, so that the removable lid may swing over the top of the body and accept the two latches to close the top of the body;

cutting an aperture for a flue duct in the removable lid of the ammunition box;

cutting an aperture in one of the sides of the ammunition box body;

providing and attaching a door for covering the aperture in one of the sides of the ammunition box body, the door being attached next to the aperture in one of the sides of the ammunition box body;

providing and attaching a set of collapsible legs to the bottom of the body, so that fuel may be burned inside the ammunition box by allowing air to enter the aperture on the side of the ammunition box and the products of combustion allowed to exit through the aperture in the removable lid, and so that the portable stove is stackable.

11. A method according to claim 10 wherein said step of cutting an aperture for a flue duct in the removable lid comprises selecting a location in the removable lid near the hinge on the side of the ammunition box body and cutting an aperture through a portion of the lid, so that the removable lid serves as a cooking surface and an attachment point for a flue duct.

12. A method according to claim 10 wherein said step of providing and attaching a door for covering the aperture in one of the sides of the ammunition box body comprises providing a substantially flat door, so that the completed stove retains approximately the same perimetry as the ammunition box body.

13. A method according to claim 11 and further comprising attaching a flue duct to the aperture in the removable lid.

14. A method according to claim 10 and further comprising cutting an aperture in the smaller side of the ammunition box body, the side having a hinge, and attaching means for delivering fluidized fuels to the portable stove.

* * * * *